United States Patent [19]

Johnson et al.

[11] 4,145,978

[45] Mar. 27, 1979

[54] SECURITY BOX

[75] Inventors: Marshall A. Johnson, Mundelein; Stanley C. Wolniak, Chicago; Herbert J. Kincaid, Libertyville, all of Ill.

[73] Assignee: The Eastern Company, Naugatuck, Conn.

[21] Appl. No.: 845,492

[22] Filed: Oct. 26, 1977

[51] Int. Cl.[2] ..... E05G 1/026

[52] U.S. Cl. ..... 109/59 R; 109/64

[58] Field of Search ..... 109/58, 59, 64, 74, 109/77; 70/63, 168; 292/202, DIG. 68

[56] References Cited

U.S. PATENT DOCUMENTS

| | | | |
|---|---|---|---|
| 2,800,090 | 7/1957 | Reid | 109/59 |
| 3,481,288 | 12/1969 | Teleky | 109/58 |
| 3,842,761 | 10/1974 | Bloom | 109/59 |

FOREIGN PATENT DOCUMENTS

| | | | |
|---|---|---|---|
| 1368 of | 1884 | United Kingdom | 109/59 |

*Primary Examiner*—Mervin Stein
*Assistant Examiner*—David H. Corbin
*Attorney, Agent, or Firm*—Wegner, Stellman, McCord, Wiles & Wood

[57] ABSTRACT

A security box is provided with a closure inserted or removed from a channelled opening in one wall thereof. The closure has a security plate attached to the inside wall thereof, which security plate has rearwardly extending flanges on two sides thereof with a portion between said sides having a flange with an elongate tongue portion adapted to extend through a slot in the channel in the box such that a latch bar of a lock can nest in an opening in the tongue behind the channel for locking the closure in place on the box. The other end portion of the security plate has an offset ledge spaced from the wall of the closure such that the ledge is positioned behind one edge of the opening in the box which, in combination with the lock, prevents removal of the closure from the box. In one modified form, the security box has outwardly facing channels completely around the opening and the security plate has two rearwardly extending tongue portions on opposite sides thereof which fit through slots in the channel so that a latch bar can simultaneously nest in openings in the two tongue portions and behind the channels for locking the closure to the box. In another modification, an interfitting portion of the security plate nests behind the one channel with the latch bar secured in an opening in the tongue portion and behind the channel so as to hold the closure securely in the opening in the box.

16 Claims, 11 Drawing Figures

SECURITY BOX

BACKGROUND OF THE INVENTION

Field of the Invention

This invention relates to a security box and, more particularly, to an improved structure for fitting a closure to the box and locking same securely in position on the box.

Description of the Prior Art

Security boxes of various types and descriptions have been known for many decades. More recently, various boxes have come on the market that provide for removing the doors or closures from the box, which doors or closures carry the closure locking arrangements. The doors or closures are fit into the opening into the box and the lock is activated to lock the doors or closures in place.

One such device includes inwardly facing slots about the opening such that one edge of the closure is inserted in the slot and shifted fairly deeply into the slot. The other part of the closure is then swung into place and shifted in a direction opposite the initial shifting so as to engage the edge of the closure opposite the initial edge behind a flange whereupon one or more locks can be activated to lock the closure to the box. This box has the disadvantage that it is possible to insert a tool between the closure and the edge of the box to pry the edge of the box outward to gain a purchase on the closure for releasing the closure from the box.

Another currently available device has a box with three outwardly facing channels and one inwardly facing channel, such that a closure having one planar edge and three inturned flanged edges can be assembled with the box by sliding the planar edge into the inwardly facing channel and dropping the three flanged edges into the outwardly facing channels. A lock is then activated to move a latch behind one channel to secure the closure to the box. In this particular type of box, once again, it is possible to pry the edge of the box away from the planar edge of the closure, thereby making it possible to remove the closure from the box. Also, it was possible to peel back the corner channels to gain access to the inner end of the flange on the closure and, thereby, pry the closure from the box.

There have been other boxes proposed, all of which suffer from one or more deficiencies in that they provided one or more weak edges between the closure and the box, which permit access of a tool whereupon the edge of the box near the closure can be peeled back to gain access to the contents of the box.

SUMMARY OF THE INVENTION

An improved security box is provided whereby in one form of our invention the opening in the box is provided with outwardly facing channels on three sides of the opening with an inwardly facing channel on the fourth side. The closure is provided with three inwardly facing flanges around three edge portions with one planar section on the fourth edge portion. A plate is secured to the back wall of the closure which has flanges extending inwardly therefrom. A tongue portion is formed on one flange and extends beyond the adjacent flange on the closure and has an elongated opening formed therethrough. The side opposite the tongued portion of the plate is deformed into an offset ledge which ledge fits over the inwardly facing channel on the box to hold that edge of the closure to the box.

The tongue portion on the closure extends through a slot in the base of one outwardly facing channel. A lock on the closure moves a latch bar into the opening in the tongue with a portion of the latch engaging behind the channel on the box. In this way, even though it may be possible to pry the edge of the box outward at the inwardly facing channel portion of the opening, it will do no good since the ledge of the plate is seated behind the channel holding the closure to the box. The tongue on the closure acts as a backing for the latch so as to prevent prying the door forward to bend the latch away from its locked position. The flanges on the plate are provided to add rigidity to the closure for preventing access to the contents of the box.

In one modification, the box is provided with an outwardly facing channel completely surrounding the opening. The closure has flanges on four sides thereof. A plate is secured to the inner portion of the closure with three sides of the plate having inturned flanges and the fourth side having an offset portion to define a ledge which lies parallel to the wall of the closure and is spaced from the edge of the flange. The side of the plate opposite the ledge has a tongue portion extending inwardly from the flange with an opening formed in the tongue. The closure is assembled with the box by threading the lip of the channel into the opening between the ledge and the flange on the closure. The closure and tongue are then swung inwardly with the tongue going into a slot in the base of said channel. A latch on the lock is swung into the opening in the tongue and behind the channel. In this form, there is no edge on the box or closure that can be pried away from the box to gain access below the edge of the closure.

A second modification provides for an outwardly facing channel around the opening in the box with a pair of slots formed in the base of the channels on opposite sides of the opening. The closure has flanges around the four sides thereof and has a plate secured to the inside wall with tongue portions extending inwardly from flanges on opposite sides of the plate, which tongue portions extend inwardly beyond the inner reaches of the flanges on the closure. The tongue portions are inserted in the slots in the channels as the closure is moved into place. A lock is activated to move latch portions of a latch bar into the openings in the tongue portions and behind the channels to lock the closure in place on the box.

BRIEF DESCRIPTION OF THE DRAWINGS

The details of construction and operation of the invention are more fully described with reference to the accompanying drawings which form a part hereof and in which like reference numerals refer to like parts throughout.

In the drawings

DESCRIPTION OF THE PREFERRED EMBODIMENT

Figure 1:
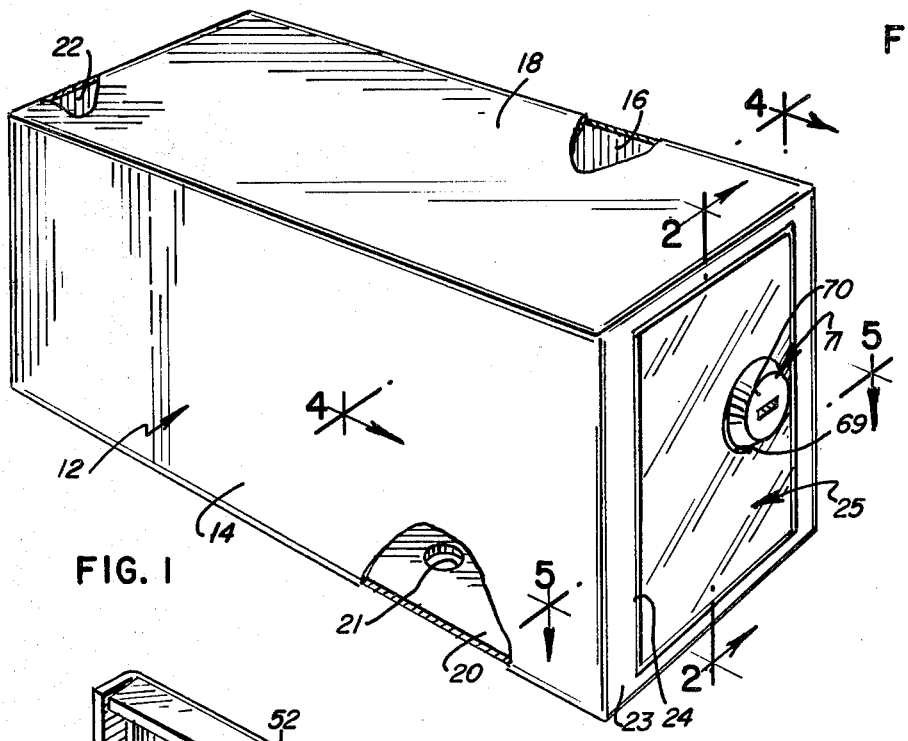
FIG. 1 is a perspective view of a security box having our improved closure in place thereon.

Referring to the drawings, and in particular to the FIGS. 1 through 5 version of our invention, the reference numeral 12 designates a security box having opposite side walls 14 and 16, a top wall 18 and a bottom wall 20. The box 12 also has a rear end wall 22 and a front end wall 23. In a well known manner, all of the corners and seams of the box 12 are welded or joined in a secure manner so as to prevent access to the contents of the box therethrough. The front end wall 23 has an access opening 24 therein in which opening is removably locked a closure or door 25. As illustrated, the front and rear end walls 22, 23 are rectangular with the long axis extending vertically. It is to be understood that the end walls could be either square or rectangular with the long axis extending horizontally without departing from the invention. Apertures 21 are provided in the bottom wall 20 for securing the box to a horizontal surface such as the deck in the trunk of a car or the apertures could be in any of the other walls, except the front wall, for attaching the box to an appropriate surface.

Figure 2:
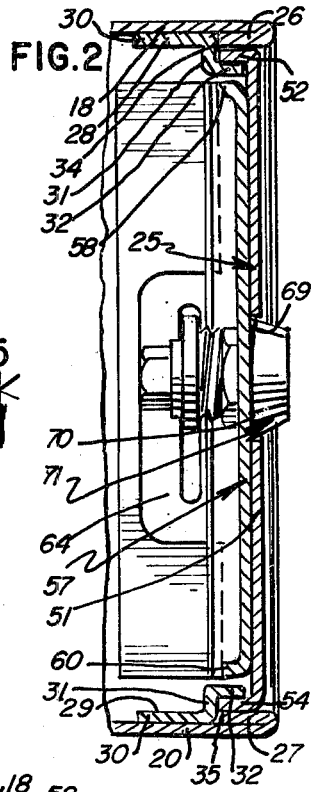
FIG. 2 is a cross-sectional view taken along the line 2—2 of FIG. 1.
Figure 3:
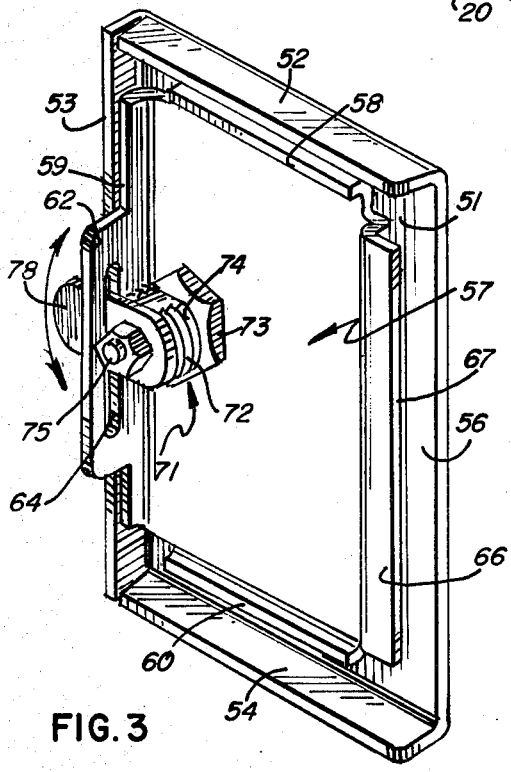
FIG. 3 is a rear perspective view of the closure of FIG. 1.
Figure 4:
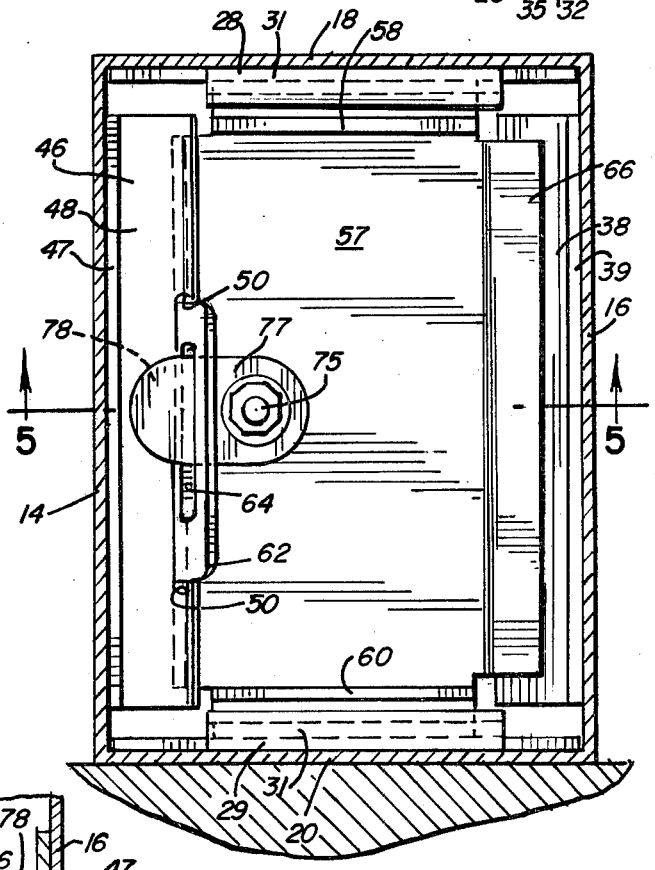
FIG. 4 is a cross-sectional view taken along the line 4—4 of FIG. 1.

The opening 24 is formed by the top edge 26 and the bottom edge 27 of the opening being folded back upon themselves, as is best shown in FIG. 2. Brackets 28 and 29, which are similar to each other, are secured to the inside of the top and bottom walls, 18 and 20, respectively, near the opening 24. Each bracket 28, 29 has an attaching portion 30, a transverse portion 31, and a projecting portion 32. The attaching portions 30 are welded, or otherwise secured, to the walls 18, 20 with the projecting portions 32 lying in spaced relationship from the folded over edges 26, 27 of the opening 24 to form two outwardly facing channels 34 and 35, respectively, on the top and bottom edges 26, 27 of the opening 24.

Figure 5:
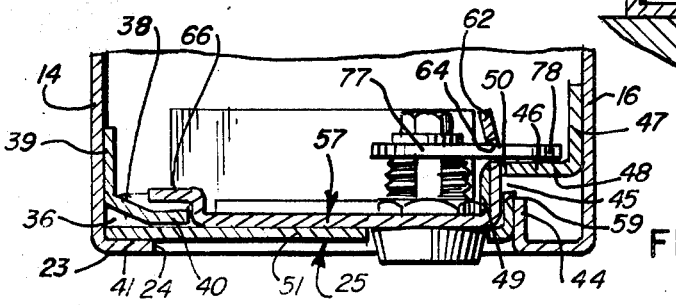
FIG. 5 is a cross-sectional view taken along the line 5—5 of FIG. 4.
Figure 8:
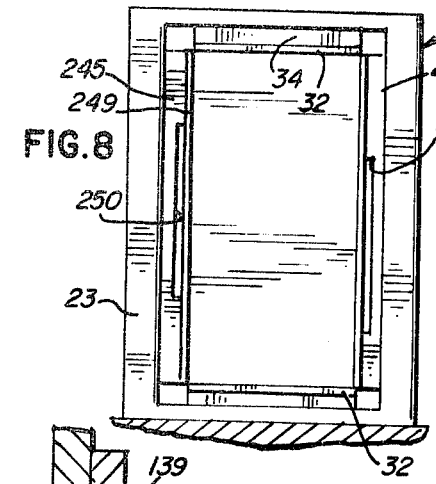
FIG. 8 is a front view of a box for use with another modified form of our invention.

As best seen in FIG. 5, the side edge of the opening 24 nearest the side wall 14 has an inwardly facing channel 36 which is defined by a bracket 38 having an attaching portion 39 welded, or otherwise secured, to the inside of the wall 14. The bracket 38 has an angled leg and a projecting portion 40, which projecting portion 40 lies substantially parallel to and is spaced from the edge portion 41 of the front end wall 23. The projecting portion 40 of the bracket 38 extends into the opening 24 beyond the limits of the edge portion 41 of the opening. The other side edge of the opening 24 is defined by an inturned flange portion 44 formed on that portion of the front end wall 23 which is joined to the outside wall 16 of the box 12. An outwardly facing channel 45 is formed with the flange 44 by a bracket 46 which has an attaching portion 47 welded, or otherwise secured, to the inside of the vertical wall 16 and has a transverse portion 48 and a projecting portion 49, which projecting portion 49 lies parallel to and spaced from the flange portion 44 to define said outwardly facing channel 45. The transverse portion 48 of the bracket 46 has an elongate slot 50 extending therethrough substantially at the base of the projecting portion 49 of the bracket. The edge of the slot 50 nearest the wall 16 is spaced inwardly from the plane containing the flange 44 of the opening 24 for a purpose to be described more completely hereinafter.

The door or closure 25 has a planar body portion 51 with three flanges 52, 53 and 54 extending rearwardly from three edges of said body 51. A fourth edge portion 56 of the body 51 of the closure 25 lies in the plane of said body portion 51. A reinforcing security plate 57 is welded, or otherwise secured, to the inside of the body portion 51 and has rearwardly extending flanges 58, 59, 60 along three edge portions thereof. The flanges 58, 60 on the top and bottom of the security plate 57 are spaced inward from the flanges 52, 54, respectively, on the edges of the body portion 51 of the closure. The third flange 59 on the security plate 57 is juxtaposed against the third flange 53 on the closure 25 and has a tongue portion 62 extending substantially transversely to the plane of the closure 25 and security plate 57. The tongue portion 62 has an elongate opening 64 lying parallel to the plane of the plate 57, which opening 64 lies just beyond the edge of the flange 53 on the one edge of the closure. The fourth edge of the security plate 57, namely the edge opposite the flange 59 supporting the tongue portion 62, has an offset ledge 66, which ledge 66 lies parallel to and spaced from the plane of the body 51 of the closure. The outer edge 67 of the ledge 66 is spaced inwardly from the outer edge of the planar edge portion 56 of the closure.

The body portion 51 of the closure 25 has an aperture 69 formed therethrough, through which the key entry portion 70 of a cam or similar type lock 71 extends. The lock 71 has a cylinder 72 passing through the security plate 57 and is secured thereto by means of a nut 73 tightened on a thread 74 on the cylinder 72 up against the inner surface of the plate 57. A shaped stud or boss 75 extends axially rearwardly from the lock cylinder 72 and is adapted to be turned by or locked in position by the key and tumbler arrangement of the lock 71. The sloping conical wall of the key entry portion 70 of the lock 71 extends out through the opening 69 in the body portion 51 of the closure 25 in such a way as to prevent prying loose of the lock 71. The lock 71, being secured to the plate 57 at a junction protected by the body portion 51 of the closure 25, prevents entry of a tool below the key entry portion 70 of said lock. A planar enlongate latch bar 77 is keyed to and bolted on the stud 75 on the cylinder 72 so as to turn with the stud 75 any time the lock 71 is activated. The latch bar 77 has a latch portion 78 which extends on both sides of the tongue 62 when the latch bar 77 is in latched position.

To assemble the closure 25 with the box 12, the planar edge 56 of the closure 25 is inserted in the inwardly facing channel 36 between the bracket 38 and the planar edge 41 of the front end wall 23 of the box. The ledge 66 on the security plate 57 extends beyond the inwardly projecting portion 40 of the bracket 38 so that the ledge 66 rests behind said bracket 38. The balance of the closure 25 is now swung into place in the opening 24 with the tongue portion 62 on the closure plate threading through the slot 50 in the base 48 of the outwardly facing channel 45 on the one edge of the opening 24.

The three flanges 52, 53, 54 on the closure 25 nest in the three outwardly facing channels 34, 35, 45 surrounding three sides of the opening 24 with the spaced top and bottom flanges 58, 60 on the security plate 57 nesting on the inside of the channels 34, 35 inboard of the brackets 28, 29 carried by the top and bottom walls 18, 20 of the security box.

The key in the lock 71 is now turned to the horizontal locked position which will pivot the latch bar 77 and will move the latch portion 78 through the opening 64 in the tongue portion 62 and into position behind transverse portion 48 of the bracket 46. The latch portion 78 of the lock 71, where it passes through the opening 64, is backed by the edges of the opening 64 making it more difficult, if not impossible, to pry the closure 25 forward, thereby bending the latch bar 77 away from the closure 25 so that it will permit the closure to be removed from the box.

In addition, the planar ledge 66 on the security plate 57, seating behind the projecting portion 40 of the inwardly facing channel 36, provides security for that edge of the closure. That is, anyone that pries the edge portion 41 of the front end wall 23 away from the closure, will not be able to pivot the door or closure 25 outwardly since the ledge 66 on the security plate 57, nesting behind said portion 40, will hold the closure 25 in position in the box.

From the above, it can be seen that the security plate 57 provides a back up ledge for preventing gaining access to the contents of the box by prying the planar edge 41 of the closure loose. The inturned flanges 58, 59 on the top and bottom of the plate 57 reinforces the closure 25 to prevent bending or distorting the closure at the corners to gain access to the box. The tongue portion 62 on the plate 57 provides a back up for the latch portion 78 of the lock 71 so that the closure 25 cannot be pried from the opening in the container by bending the latch bar 77 away from the lock.

Figure 6:
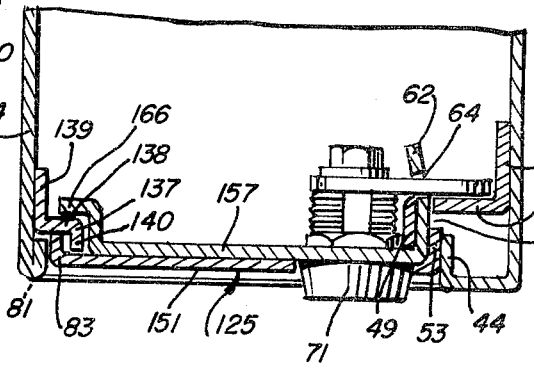
FIG. 6 is a cross-sectional view similar to FIG. 5 only showing a modified form of interconnection between the closure and the box.
Figure 7:
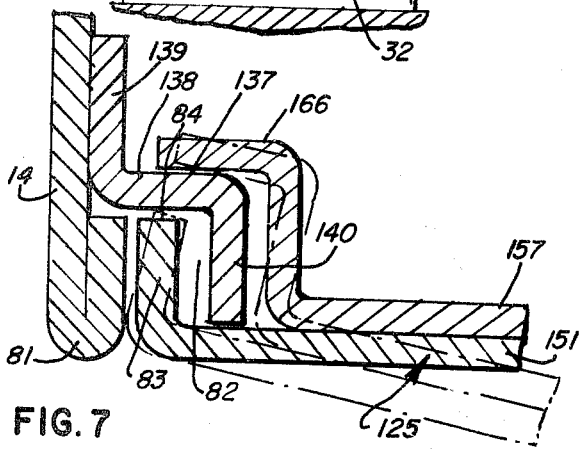
FIG. 7 is a broken away view of FIG. 6, slightly enlarged, showing the interconnection between one portion of the closure both in phantom and in solid line positions relative to the box.
Figure 9:
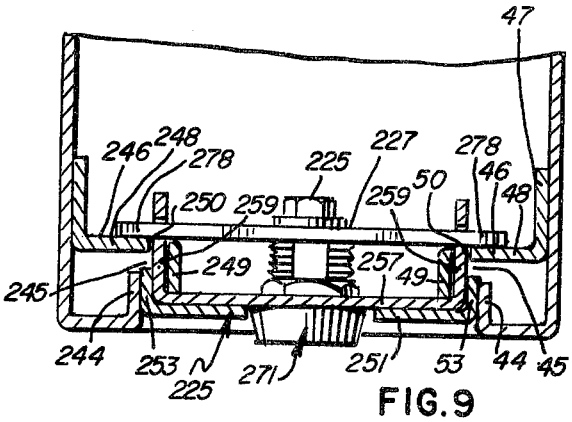
FIG. 9 is a cross-sectional view taken along the line 9—9 of FIG. 10.
Figure 10:
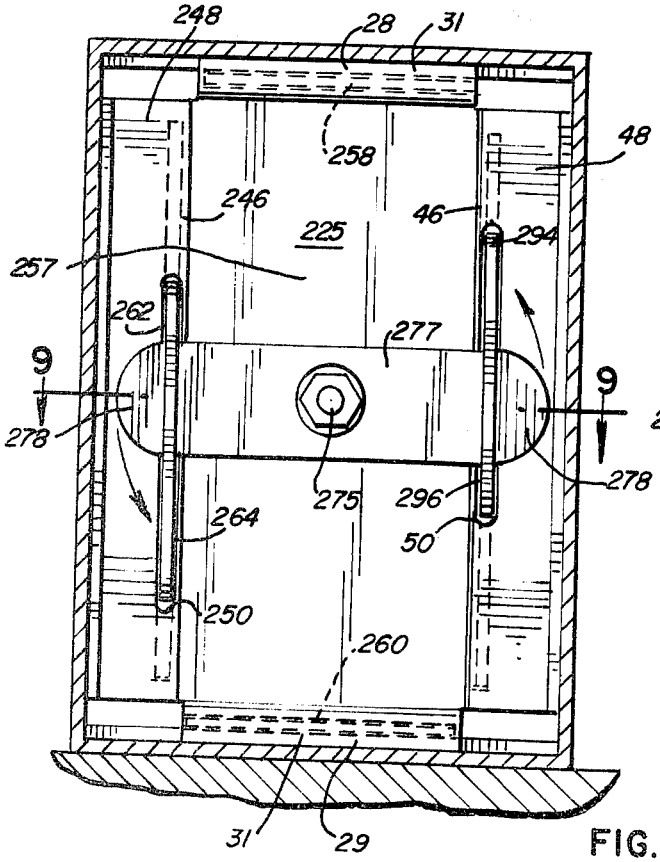
FIG. 10 is a cross-sectional view similar to FIG. 4 only employing our improved closure and latching arrangement; and, FIG. 11 is a rear perspective view of the modified form of closure shown in FIGS. 9 and 10.
Figure 11:
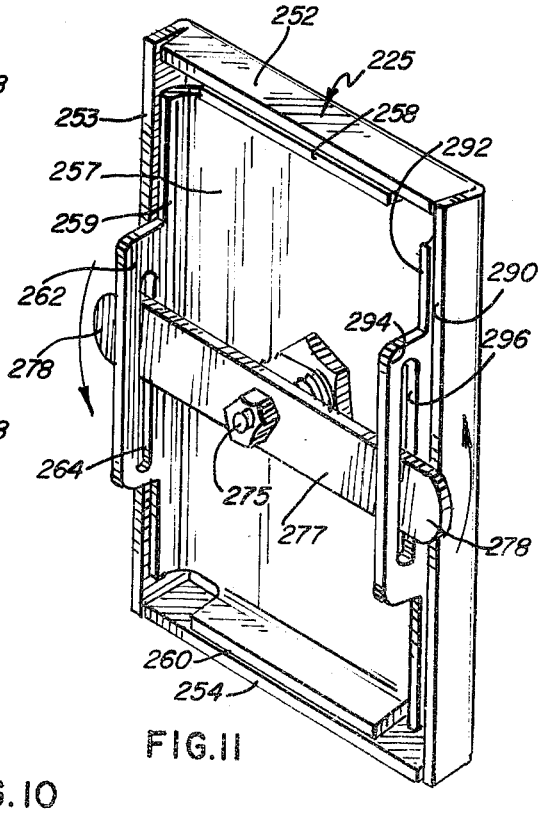

In the modification of our invention shown in FIGS. 6 and 7, the outwardly facing channels 34, 45, 35 at the top, the bottom and the latch edge of the opening 24 are identical to that described in FIGS. 1 through 5. On the fourth edge of the opening, namely, the edge of the opening adjacent the vertical wall 14, an improved connection is provided. That is, the portion 41 of the front end wall 23 is bent back upon itself to form an edge 81 so that the top, bottom and one vertical edge of the opening 24 all have double edges. A bracket 138 has an attaching portion 139 welded, or otherwise secured, to the inside of the wall 14 with a transverse portion 137 and a projecting portion 140. The projecting portion 140 lies parallel to and spaced from the edge 81 of the opening 24 to define an outwardly facing channel 82. In this way, the security box 12 now has an opening 24 which has all four edges of the opening 24 defined by outwardly facing channel portions 34, 45, 35, 82. The closure 125 has the top, bottom and latch portions thereof, the same as that described with respect to FIGS. 1 through 5. The edge of the body portion 151 of the closure 125 opposite the tongue portion 62 has a fourth flange 83 formed by turning the edge of the closure transversely inward thereof so that the closure body portion 151 now has four inturned flanges 52, 53, 54 and 83 around the outer edge thereof. The security plate 157 has the ledge 166 spaced slightly farther away from the plane of the closure than previously so as to define an opening 84 between the ledge 166 and the inturned flange 83 on the fourth side of the closure.

In use, the projecting portion 140 of the bracket 138 is threaded in the opening 84 between the ledge 166 on the security plate 157 and the inturned flange 83 on the closure 125 to the phantom line position of FIG. 7, whereupon the closure 125 is swung into the solid line position of FIG. 7 with the remaining flanges 52, 53, 54 on the closure nested in the channels 34, 45, 35 defining the opening 24 in the security box. The key lock 71 is now turned to move the latch portion 78 of the latch bar 77 into the opening 64 in the tongue portion 62 and behind the channel 45 to secure the closure 125 to the security box.

In summary, the modification of our invention, shown in FIGS. 6 and 7, has the opening in the box defined by four outwardly facing channels 34, 35, 45, 82. The closure has four rearwardly extending flanges 52, 53, 54, 83 which are adapted to nest in said outwardly facing channels. The closure 125 has a ledge 166 spaced rearward from the flange 83 which is adapted to nest behind the channel 82 defining one wall of the opening. This will provide security for all edges of the closure. The box does not have any planar edges around the opening 24 into the box thereby eliminating areas where a tool has access for prying said planar edge from the box to gain access to the edges of the closure.

The modification of our invention shown in FIGS. 8 through 11 has four outwardly facing channels defining the opening 24 into the box so that the top and bottom channels 34, 35 are identical to those described with respect to FIGS. 1 through 5. The vertical channels 45, 245 are identical to the description set forth with respect to the one channel 45 along one edge of the opening of FIGS. 1 through 5. That is, the channel 45 defines the one vertical edge of FIGS. 1 through 5, and has a slot 50 formed in the base or transverse portion 48 thereof. The channel 245 is a repeat of channel 45 and is formed on the opposite edge of the opening. A rearward extending flange 244 is formed on the end wall which flange is spaced from a projecting portion 249 on a bracket 246 secured to the wall 14. The transverse portions 48, 248 of the brackets 46, 246 have slots 50, 250 formed therein, which slots 50, 250 have one edge spaced inwardly from the planar surface of the inturned flanges 44, 244 of the opening.

The closure 225 has four rearwardly extending flanges 252, 253, 254 and 290 with a security plate 257 welded, or otherwise secured, to the back thereof with the inturned flanges 258, 260 on the top and bottom edges thereof facing inwardly and abutting against the inside of flanges 252, 254. The remaining two edges of the security plate 257 have flanges 259, 292 which are bent transversely rearward therefrom and lie parallel to each other and abut against the flanges 253, 290 on the closure. The flanges 259, 292 have inwardly extending tongue portions 262, 294 which lie parallel to each other and have openings 264, 296 therethrough which openings 264, 296 lie beyond the edges of the inturned flanges 253, 290 of the closure.

A cam or similar type lock 271 is attached to the plate 257 and projects through the body portion 251 of the closure 225. The lock 271 has a rearwardly extending stud or boss 275 to which is secured an elongated latch bar 277, the latch bar 277 being keyed to the stud 275 so as to turn with the stud. The elongated latch 277 extends on opposite sides of the lock 271 and has latch end portions 278, 278 diametrically opposite from each other. As shown, the lock 271 is centrally disposed with respect to the closure 225 and plate 257 so that the latch portions 278 are symmetrical and equal in length with respect to the stud. The latch portions 278 of the latch 277 are adapted to pivot into the openings 264, 296 in the tongue portions 262, 294 or to be retracted therefrom, when desired.

In assembling the closure to the box, the latch portions 278, 278 are retracted from the openings 264, 296 in the tongue portions 262, 294 and the flanges 252, 253, 254, 290 on the closure and the tongue portions 262, 294 on the plate 257 are aligned with and insert into the opening in the security box with the four flanges 252, 253, 254, 290 nesting in the four channels 34, 35, 45, 245 defining the opening in the box. The flanges 258, 260, 259 and 292, likewise, nest in the channels 34, 35, 45, 245 with the tongue portions 262, 294 extending through the slots 50, 250 in the channels 45, 245 so that the openings 264, 296 in the tongue portions 262, 294 lie beyond the inner edges of the intermediate portions or bases 48, 248 of the brackets 46, 246. Turning the key in the lock 271 will pivot the latch to move the latch portions 278, 278 through the openings 264, 296 in the tongue portions 262, 294 and into position behind the channels 45, 245 defining the two edges of the opening 24 in the box. The box is now secure with no planar edges available for prying and no way that a tool can be inserted between the closure and the box to pry the closure loose. The slots 50, 250 in the bases 48, 248 of the two channels 45, 245 being offset from the planes of the rearward flanges 44, 244 of the opening 24 are out of alignment with said opening 24 so that it is not possible to enter a saw between the closure and the flanges 44, 244 and through the slots 50, 250 so as to saw the latch portion 278 from the latch.

We have provided a security box and closure which has eliminated all of the shortcomings of the prior art making it almost impossible to gain access to the contents of the box by prying or tearing edges of the opening into the box back enough to release the closure. One version of our invention provides a ledge behind the channel to prevent release of the closure by prying the edge of the opening back from the closure. We have also provided outwardly facing channels and rearwardly extending flanges nesting in the channels with a backing support for the latch portion of the lock such as to prevent bending the latch portion from the lock. There are no weak parts in our closure and box combination and, therefore, a secure box is provided.

We claim:

1. A security box having an opening in one wall for gaining access into the box, an outwardly facing channel along at least one edge of said opening, said channel having a slot through the base of said channel, closure means having at least one flange extending rearwardly therefrom, at least one rearwardly extending tongue portion on said closure means in close proximity to said flange, said flange nesting in said channel and said tongue portion extending through said slot when said closure means is inserted in said opening, an opening extending through said tongue portion and aligning with the rear of the base of said channel, and lock means on said closure means and having a latch movable into said opening in the tongue portion and rearward of said base of said channel whereby said closure means is secured to said box with said latch supported by said tongue portion to prevent bending said latch from said lock.

2. In a security box as claimed in claim 1 wherein said opening in the box is defined by three outwardly facing channels and one inwardly facing channel and wherein said closure means has a planar edge engaging in said inwardly facing channel.

3. In a security box as claimed in claim 2 wherein means on said closure means seat behind a base of said inwardly facing channel to secure said closure means to said box.

4. In a security box as claimed in claim 1 wherein said opening in the box has four outwardly facing channels and wherein said closure means has means for engaging behind a base of one of said channels.

5. A security box having an opening in one wall for gaining access into the box, an outwardly facing channel along at least one edge of said opening, said channel having a slot through the base of said channel, closure means having at least one flange extending rearwardly therefrom, at least one rearwardly extending tongue portion on said closure means in close proximity to said flange, said flange nesting in said channel and said tongue portion extending through said slot when said closure means is inserted in said opening, an opening extending through said tongue portion and aligning with the rear of the base of said channel, lock means on said closure means and having a latch movable into said opening in the tongue portion and rearward of said base of said channel whereby said closure means is secured to said box with said latch supported by said tongue portion to prevent bending said latch from said lock, said opening has four outwardly facing channels with slots formed in the base of two said channels, and wherein two tongue portions are formed on said closure means, said tongue portions extending through said slots in said channels, openings formed in each of said tongue portions and said latch on said lock engaging in the openings in both of said tongue portions and seating behind the bases of said channels.

6. A security box having an opening in one wall for gaining access into the box, an outwardly facing channel along three edges of said opening and an inwardly facing channel along the remaining edge of said opening, one of said outwardly facing channels having a slot through the base of said channel, a closure having flanges extending rearwardly from three edges thereof, said flanges nesting in said outwardly facing channels and a planar edge of said closure nesting in said inwardly facing channel, a tongue portion extending rearwardly from said closure at a location close to one of said flanges and passing through said slot in said channel, an opening in said tongue portion aligned with the inner side of the base of said channel, and lock means on said closure and having a latch movable into said opening in the tongue portion and seating against the inner side of said base of the channel whereby the walls of said opening provide a backing for said latch.

7. A security box as claimed in claim 6 wherein ledge means are carried by said closure and extend behind said inwardly facing channel.

8. A security box having an opening in one wall for gaining access into the box, an outwardly facing channel along three edges of said opening and an inwardly facing channel along the remaining edge of said opening, the middle of said three outwardly facing channels having a slot through the base of said channel, said slot extending parallel to one of the edges of the opening and being spaced inward from said edge, closure means having a planar body portion with flanges extending rearwardly from three of the outer edges thereof, the fourth edge of said body portion lying in a common plane with said body portion, a plate secured to the back of said closure means and having flanges extending rearwardly from three edges thereof, the middle of said flanges on said plate being juxtaposed with respect to the middle of said flanges on said closure with the remaining flanges on the plate being spaced inwardly from the remaining flanges on the body portion, a rearwardly extending tongue portion formed on the middle of said flanges on the plate and having an opening therethrough rearward of the edge of said flange on the body portion, the edge of said plate opposite to the flange containing said tongue portion has an offset ledge spaced from the body portion of said closure, said offset ledge seating beyond the inner wall of said inwardly facing channel when said fourth edge of said closure is nested in said inwardly facing channel, the flanges on said closure means nesting in said outwardly facing channels on said box with said tongue portion extending through said slot in said middle flange and said opening in said tongue portion lying inwardly of the base of said middle channel, lock means mounted on said plate with the key entry portion extending through an opening in said body portion and having a stud portion extending rearward therefrom, latch means on said stud portion movable with said stud portion in a plane parallel to the plane of said plate, said latch means passing through said opening in the tongue portion and seating inward of the base of said middle channel for locking said closure means to said box.

9. A security box having an opening in one wall for gaining access into the box, an outwardly facing channel along the four edges of said opening, one of said channels having a slot formed through the base of the channel, closure means having a flange extending rearwardly from the four outer edges thereof, a tongue portion carried by said closure means and extending rearwardly therefrom in close proximity to one of said flanges, said tongue portion extending beyond said flange on said closure means and having an opening formed therethrough at a location beyond said flange on said closure means, a ledge carried by said closure means and lying parallel thereto, said ledge engaging beyond one of the channels with the flanges on said closure means nesting in said channels and with said tongue portion extending through said slot in said channel, said opening in said tongue portion lying beyond the base of said channel, lock means mounted on said closure means, latch means on said lock means adapted to be inserted in said opening in said tongue portion and beyond said base of said channel for locking said closure means to said box.

10. A security box as claimed in claim 9 wherein said slot in said channel is elongated and extends parallel to one edge of said opening in the box, said slot is spaced inward from the plane of the outer wall of the channel so as to be out of alignment with said outer wall.

11. A security box as claimed in claim 9 wherein said closure means has a plate secured to the inner surface thereof, said tongue portion is formed on said plate and is juxtaposed with respect to one of said flanges of said closure means, and said ledge is formed on said plate on the side of said plate opposite to said tongue portion.

12. A security box having an opening in one wall for gaining access into the box, an outwardly facing channel along the four edges of said opening, one of said channels having a slot formed through the base of the channel and extending parallel to one edge of the opening and spaced inward from said edge, closure means having a body portion with a flange extending rearwardly from the four outer edges thereof, a plate secured to the back of said closure means and having flanges extending rearwardly from the four edges thereof, two of said flanges on the plate being spaced inwardly from two of the flanges on said body portion, one of the remaining flanges on said plate being juxtaposed to one of the flanges on said body portion and having a tongue portion extending rearwardly therefrom, said tongue portion extending beyond the flange on said body portion and having an elongate opening formed therethrough at a location beyond the edge of said flange on said body portion, the remaining flange on said plate having a ledge extending outwardly therefrom and lying parallel to said body portion, said ledge engaging beyond the channel on one side of said opening with the flanges on said body portion nesting in said channels on said box and with said tongue portion extending through said slot in said channel, said opening in said tongue portion lying beyond the base of said channel, lock means mounted on said plate with the key entry portion extending through an opening in said body portion and having a stud portion extending rearward therefrom, latch means on said stud adapted to be inserted in said opening in said tongue portion and beyond said base of said channel for locking said closure means to said box.

13. A security box having an opening in one wall for gaining access into the box, an outwardly facing channel along the edges of said opening, a slot formed in the base of two of said channels, closure means having a flange extending rearwardly from the outer edges thereof, a pair of tongue portions carried by said closure means and extending rearwardly beyond the edges of the flanges on said closure means, said tongue portions having openings formed therethrough at locations beyond said flanges on said closure means, the flanges on said closure means nesting in said channels on said box with said tongue portions extending through said slots in said channels, said openings in said tongue portions lying beyond the bases of said channels, lock means mounted on said closure means, and latch means on said lock means movable into said openings in said tongue portions and behind said bases of said channels for locking said closure means to said box.

14. A security box as claimed in claim 13 wherein said opening in said box and said closure means are rectangular in shape.

15. A security box having an opening in one wall for gaining access into the box, an outwardly facing channel along the edges of said opening, a slot formed in the base of two of said channels, closure means having a flange extending rearwardly from the outer edges thereof, a pair of tongue portions carried by said closure means and extending rearwardly beyond the edges of the flanges on said closure means, said tongue portions having openings formed therethrough at locations beyond said flanges on said closure means, the flanges on said closure means nesting in said channels on said box with said tongue portions extending through said slots in said channels, said openings in said tongue portions lying beyond the bases of said channels, lock means mounted on said closure means, latch means on said lock means movable into said openings in said tongue portions and behind said bases of said channels for locking said closure means to said box, said slots are formed in channels on opposite sides of said opening and wherein a plate is secured to said closure means, said tongue portions being integrally formed with said plate and projecting from opposite sides thereof, and said latch means is an elongate bar with latch portions on each end thereof, said latch bar pivotong said latch portions into said openings and behind said bases of said channels.

16. A security box having an opening in one wall for gaining access into the box, an outwardly facing channel along the edges of said opening, each of two of the diametrically opposite channels having a slot through the base of the channel and extending parallel to one of the edges of the opening and spaced inward from said edges of the opening, a closure means having a flange extending rearwardly from the outer edges thereof, a plate secured to the back of said closure means and having flanges extending rearwardly from two opposite sides thereof, a pair of flanges extending rearwardly from the other two opposite sides of said plate and having tongue portions on said flanges extending rearwardly beyond the edges of said flanges on said closure means, said tongue portions having openings formed therethrough at locations beyond said flanges on said closure means, the flanges on said closure means nesting in said channels on said box with said tongue portions extending through said slots in said channels and said openings in said tongue portions lying beyond the bases of said channels, lock means mounted on said plate with the key entry portion extending through an opening in said closure means and having a stud portion extending rearward from said plate, latch means on said stud portion being movable with said stud portion in a plane parallel to the plane of said plate, said latch means being moved into said openings in said tongue portions and behind said channels for locking said closure means to said box.

* * * * *